US006789635B2

(12) United States Patent
Wentworth et al.

(10) Patent No.: US 6,789,635 B2
(45) Date of Patent: Sep. 14, 2004

(54) DRILL BIT FOR DIRECTIONAL DRILLING IN COBBLE FORMATIONS

(75) Inventors: Steven W. Wentworth, Brookfield, WI (US); Robert F. Crane, Oconomowoc, WI (US); Douglas B. Caraway, Kingwood, TX (US)

(73) Assignee: Earth Tool Company, L.L.C., Oconomowoc, WI (US)

( * ) Notice: Subject to any disclaimer, the term of this patent is extended or adjusted under 35 U.S.C. 154(b) by 35 days.

(21) Appl. No.: 10/173,995

(22) Filed: Jun. 18, 2002

(65) Prior Publication Data

US 2003/0024741 A1 Feb. 6, 2003

Related U.S. Application Data

(60) Provisional application No. 60/299,008, filed on Jun. 18, 2001.

(51) Int. Cl.[7] ..... E21B 10/00; E21B 10/60

(52) U.S. Cl. ..... 175/398; 175/327; 175/340

(58) Field of Search ..... 175/73, 327, 340, 175/398, 399

(56) References Cited

U.S. PATENT DOCUMENTS

| | | | | | |
|---|---|---|---|---|---|
| 618,422 | A | * | 1/1899 | LeRoux | 175/18 |
| 2,088,197 | A | * | 7/1937 | Gairoard | 175/398 |
| 3,095,053 | A | * | 6/1963 | Pistole et al. | 175/327 |
| 4,694,913 | A | | 9/1987 | McDonald et al. | 175/61 |
| 4,784,230 | A | | 11/1988 | Cherrington et al. | 175/61 |
| 4,867,255 | A | | 9/1989 | Baker et al. | 175/61 |
| 4,907,658 | A | | 3/1990 | Stangl et al. | 175/19 |
| 4,945,999 | A | | 8/1990 | Malzahn | 175/19 |
| 4,953,638 | A | | 9/1990 | Dunn | 175/61 |
| 5,070,948 | A | | 12/1991 | Malzahn et al. | 175/19 |
| RE33,793 | E | | 1/1992 | Cherrington et al. | 175/61 |
| 5,148,880 | A | | 9/1992 | Lee et al. | 175/393 |
| 5,242,026 | A | | 9/1993 | Deken et al. | 175/62 |
| 5,253,721 | A | | 10/1993 | Lee | 175/73 |
| 5,497,842 | A | | 3/1996 | Pastusek et al. | 175/334 |
| 5,633,589 | A | | 5/1997 | Mercer | 324/326 |
| 5,647,448 | A | | 7/1997 | Skaggs | 175/421 |
| 5,678,644 | A | | 10/1997 | Fielder | 175/391 |
| 5,765,653 | A | | 6/1998 | Doster et al. | 175/75 |
| 5,778,991 | A | | 7/1998 | Runquist et al. | 175/61 |
| 5,795,991 | A | | 8/1998 | Hesse et al. | 73/12.09 |
| 5,799,740 | A | | 9/1998 | Stephenson et al. | 175/62 |
| 5,899,283 | A | | 5/1999 | Cox | 175/376 |
| 5,931,240 | A | | 8/1999 | Cox | 175/73 |
| 5,950,743 | A | | 9/1999 | Cox | 175/61 |
| 6,102,486 | A | | 8/2000 | Briese | 299/111 |
| 6,148,935 | A | | 11/2000 | Wentworth et al. | 175/398 |

OTHER PUBLICATIONS

Spirol Coiled Pins Brochure, Spirol International Corporation, Feb., 1997, 14 pages.

Geological Boring Advertisements for Sonde Housing; Duro Bore all soil bits; Duro Spade; Quick–Steer; Bog–Hog Conical Steering Head; Sonde Housing Combination; and Back Reamer; Vermeer–Illinois, INc., 6 pages, undated.

* cited by examiner

*Primary Examiner*—David Bagnell
*Assistant Examiner*—Brian Halford
(74) *Attorney, Agent, or Firm*—Philip G. Meyers

(57) ABSTRACT

A drill bit configured for use in horizontal directional boring includes a spoon-shaped body with a rearwardly angled or inclined arcuate front end face that widens from a leading edge to a trailing edge in a circumferential direction, the front face sloping rearwardly from a leading side surface to a trailing edge in a circumferential direction, the leading and trailing side surfaces extending rearwardly in from the front end face. The leading side surface is wider than the trailing side surface. In one configuration, the front end surface and leading side face are each provided with a plurality of carbide inserts or studs which may be arranged in a row.

33 Claims, 7 Drawing Sheets

DRILL BIT FOR DIRECTIONAL DRILLING IN COBBLE FORMATIONS

This application claims priority of U.S. Provisional Patent Application Ser. No.: 60/299,008, filed Jun. 18, 2001.

TECHNICAL FIELD

The invention relates to directional boring and, in particular to a bit and method for boring through cobble formations.

BACKGROUND OF THE INVENTION

Directional boring apparatus for making holes through soil are well known. The directional borer generally includes a series of drill rods joined end to end to form a drill string. The drill string is pushed or pulled though the soil by means of a powerful hydraulic device such as a hydraulic cylinder. See Malzahn, U.S. Pat. Nos. 4,945,999 and 5,070,848, and Cherrington, U.S. Pat. No. 4,697,775 (RE 33,793). The drill string may be pushed and rotated at the same time as described in Dunn, U.S. Pat. No. 4,953,633 and Deken, et al., U.S. Pat. No. 5,242,026. A spade, bit or head configured for boring is disposed at the end of the drill string and may include an ejection nozzle for water to assist in boring.

In one variation of the traditional boring system, a series of drill string rods are used in combination with a percussion tool mounted at the end of the series of rods. The rods can supply a steady pushing force to the impact and the interior of the rods can be used to supply the pneumatic borer with compressed air. See McDonald et al., U.S. Pat. No. 4,694,913. This system has, however, found limited application commercially, perhaps because the drill string tends to buckle when used for pushing if the bore hole is substantially wider than the diameter of the drill string.

Accurate directional boring necessarily requires information regarding the orientation and depth of a cutting or boring tool, which almost inevitably requires that a sensor and transmitting device ("sonde") be attached to the cutting tool to prevent mis-boring and re-boring. One such device is described in U.S. Pat. No. 5,633,589, the disclosure of which is incorporated herein for all purposes. Baker U.S. Pat. No. 4,867,255 illustrates a steerable directional boring tool utilizing a pneumatic impactor.

At present, when underground utilities such as natural gas, potable water, or sanitary sewer pipes are placed in rock, trenches are excavated using large hard rock trenching equipment such as the Vermeer T-655, or possibly even shot using explosives. In these conditions, electric, telephone and cable TV lines are normally strung overhead along poles, mostly due to the difficulty and expense of placing them underground. Directional boring tools with rock drilling capability are described in Runquist U.S. Pat. No. 5,778,991 and in Cox European Patent Applications Nos. EP 857 852 A2 and EP 857 853 A2. Hardrock drilling normally consists of penetrating monolithic masses of solid rock such as granite in which known techniques for steering a drill bit may be employed.

However, many sites where rock strata exists include loose cobble formations. Cobble formations comprise loose rock formations including stones varying from potato size to basketball sized with voids or sand between the rocks. Drilling such formations with a directional drilling machine is problematic in that formation is not cut in the manner in which a typical rock formation is drilled. Rather, loose rocks, soil and debris must be displaced and/or compacted in order to form a bore and allow the bit and drill string to move forward though the strata in the desired direction. In such a situation, rock drilling or trenching equipment may lack the capability to displace cobble while simultaneously providing the desired steering capability. The present invention addresses this need.

SUMMARY OF THE INVENTION

The invention provides a drill bit configured for use in horizontal directional boring, and in particular horizontal drilling through cobble formation that is adapted for use with a impactor. The bit includes a spoon-shaped body and a generally cylindrical base configured for connection to the drill string. The spoon shaped body defines a conical inner surface for steering the bit in soil and an arcuate front end face that slopes rearwardly from a leading edge to a trailing edge in a circumferential direction. The arcuate front end face extends through an arc of up to 270°, and preferably from about 30° to about 180°.

The conical face is preferably offset in that the front end face of the bit widens from the leading side surface of the bit to the trailing side surface. In this aspect, the front end face and the conical inner face may be provided with a plurality of carbide inserts to protect the bit from abrasion during the drilling operation.

In another aspect, the bit is configured with one or more fluid ports that eject drilling fluid into the bore adjacent to the bit to lubricate the bit and wash away sand and soil from between the rocks in the cobble formation. In this respect, the bit may include a longitudinal groove associated with each nozzle, the nozzle being positioned in the groove so that drilling fluid ejected from the nozzle is directed to the front end face of the bit. In one configuration, a pair of fluid ports are positioned in a pair of longitudinal grooves in the spoon-shaped body, the grooves extending from the fluid ports to the front end face to direct drilling fluid ejected through the ports into the bore adjacent to the front end face.

In one aspect the spoon-shaped body is outwardly offset in a radial direction from the base and the arcuate front end face is angled rearwardly at an angle of up to about 30°, more preferably from about 5° to about 20°.

In another aspect, the drill bit further comprising a leading side surface and a trailing side surface. The leading side surface is narrower than the trailing side surface so that the bit acts in a wedge like manner, biting into openings between rocks in the cobble formation. In one configuration, the leading side surface is provided with a row of carbide inserts or studs to protect the surface from abrasion. In another configuration, a layer of wear resistant hard metal is applied by welding to the leading side surface and/or arcuate front end face.

These and other features and advantages are further detailed and illustrated in the following Detailed description and the Drawings.

BRIEF DESCRIPTION OF THE DRAWINGS

In the accompanying drawings, like numerals represent like elements except where section lines are indicated.

DETAILED DESCRIPTION OF THE INVENTION

While the making and using of various embodiments of the present invention are discussed in detail below, it should be appreciated that the present invention provides many applicable inventive concepts which can be embodied in a wide variety of specific contexts. The specific embodiments discussed herein are merely illustrative of specific ways to make and use the invention and are not to delimit the scope of the invention.

Figure 1:
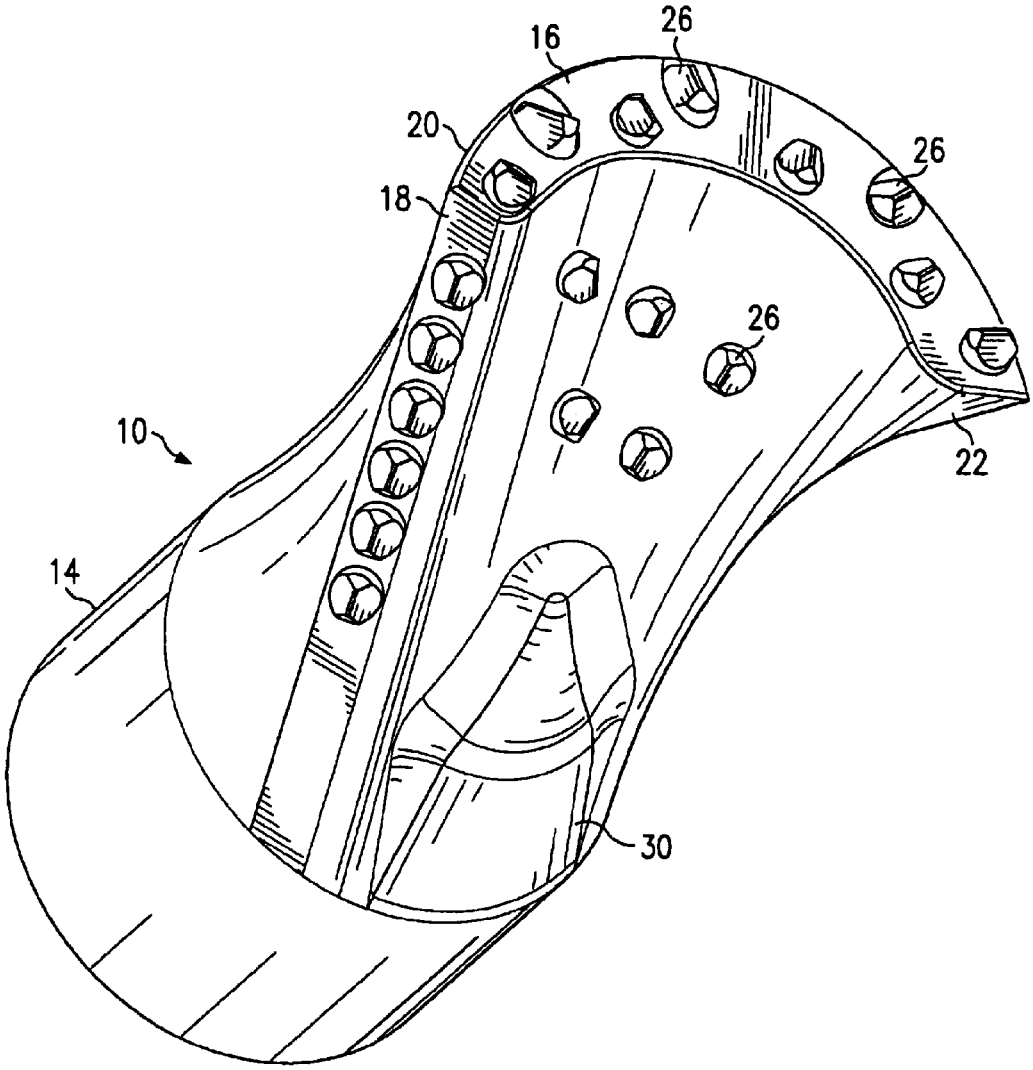
FIG. 1 is perspective view of a first drill bit according to the invention.

Referring to FIG. 1, a drill bit 10 according to the invention comprises a generally spoon or scoop-shaped body 12 projecting from a cylindrical base coupling portion 14. Base 14 may incorporate any conventional connection used for connecting a bit to a sonde housing or other component of a drill head mounted at the end of a drill string driven by a horizontal directional boring tool, such as a threaded socket or projection, or may be a splined socket such as disclosed in Wentworth et al., U.S. Pat. No. 6,148,935, issued Nov. 21, 2000, incorporated by reference herein, or Wentworth et al., PCT Publication WO 00/11303, published Mar. 2, 2000, the disclosures of which are incorporated by reference herein.

Figure 2:
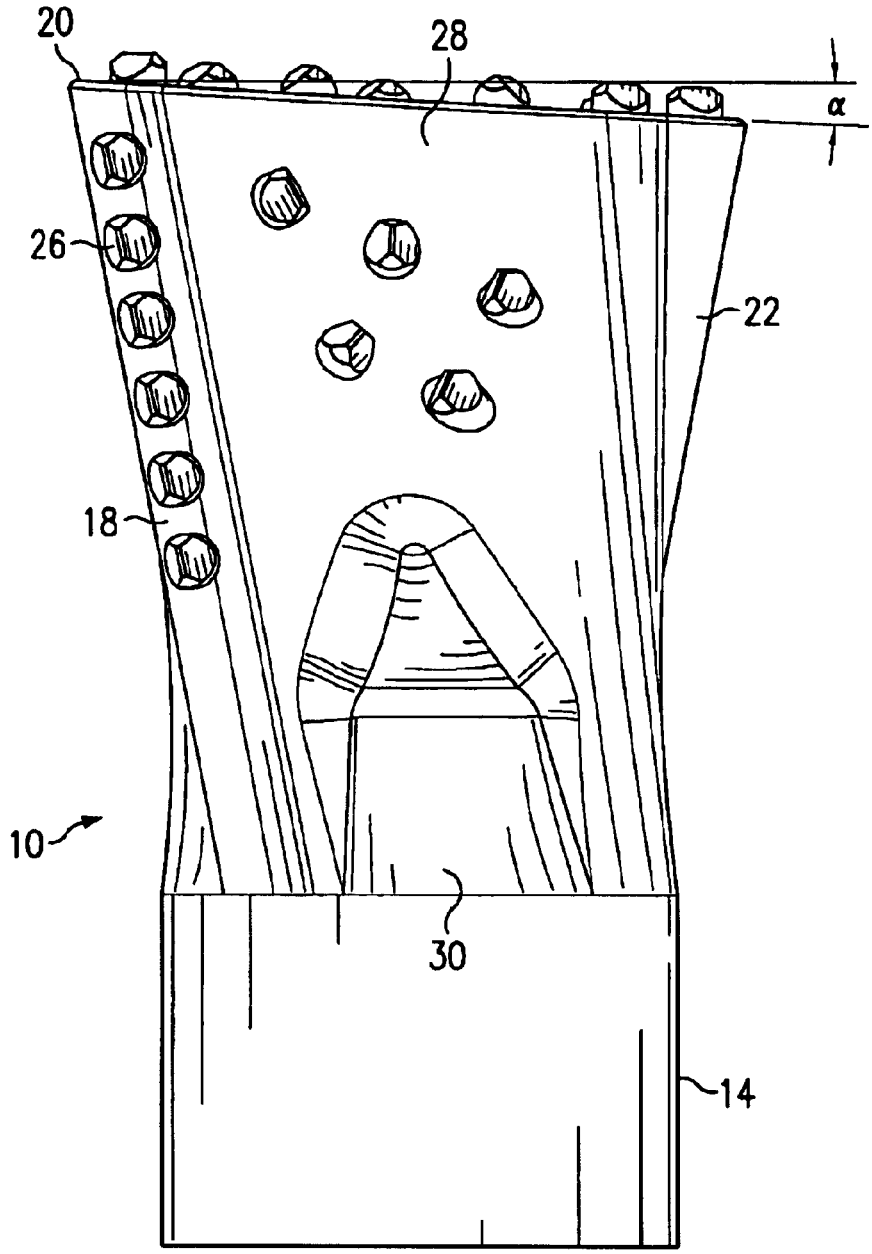
FIG. 2 is bottom view of the drill bit of FIG. 1.
Figure 3:
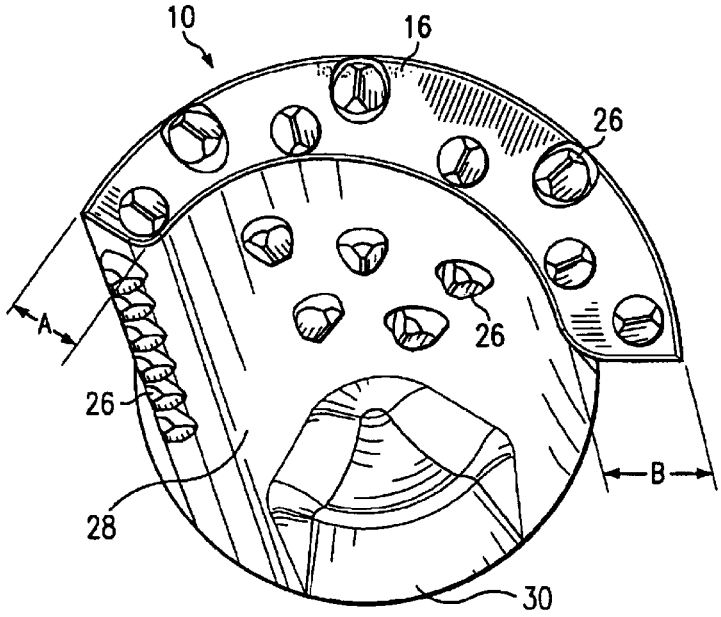
FIG. 3 is a front view of the drill bit of FIG. 1.

Body 12 includes a front end face 16 that defines an arc in the circumferential direction of the bit covering less than 270 degrees, preferably in the range of 30 to 180 degrees, as measured from the axis of rotation of bit 10. As shown in FIG. 2, front end face 16 is rearwardly inclined from corner 20 at an angle $\alpha$ of up to 30°, preferably from about 5° about 20°. Relieving front end face 16 in this manner creates an aggressive leading edge in the thrust direction. Body 12 further comprises a leading side surface or face 18 and a trailing side surface or face 22, each of which extend longitudinally in a reward direction from the front end of surface 16. Leading side surface 18 has a width A that is narrower than width B of the trailing side surface 22. The taper formed in body 12 from narrow side face 18 to trailing side face 22 allows the leading side surface to function as a wedge when torque is applied to the bit. Since boring in a cobble formation requires displacement of rocks and soil, as opposed to cutting a solid rock formation, the wedge-like action of narrow leading side surface 18 will improve the rate at which the bore is formed as well as forming a more stable bore through compaction of soil around the bore. As shown, front face 16 and leading side surface 18 are both provided with a row of spaced apart carbide studs or inserts 26 to protect body 12 from abrasion during the boring process. Alternatively, a layer of hard, wear resistant metal may be applied by welding to the front face and leading side surface 18 for abrasion protection.

Figure 5:
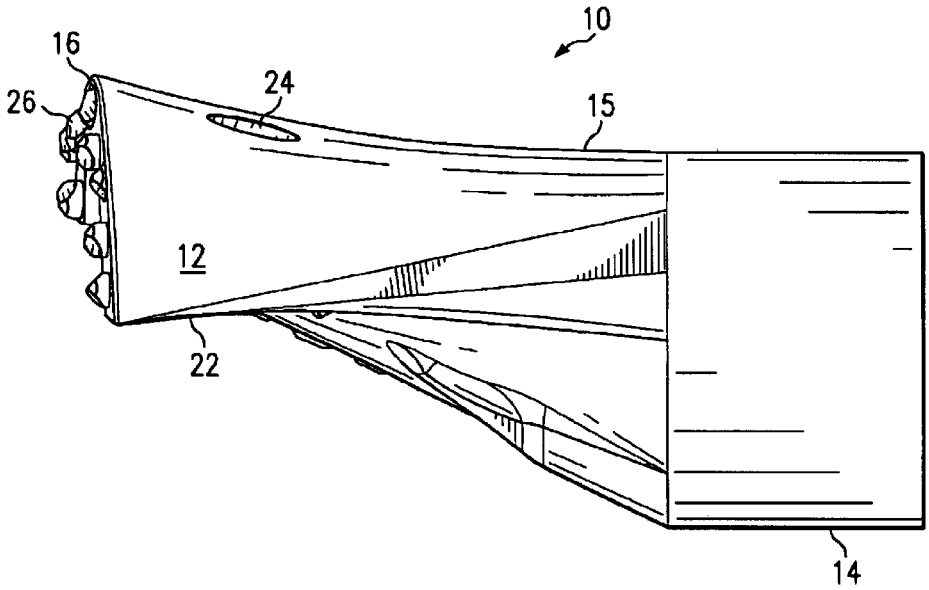
FIG. 5 is a side view of the drill bit of FIG. 1.
Figure 6:
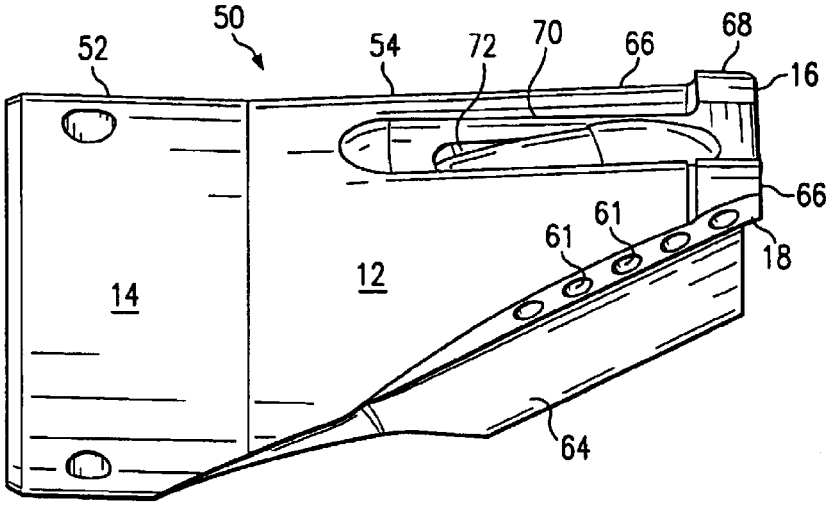
FIG. 6 is a side view of a second drill bit according to the invention.

The relieved or angle front end face 16 together with narrow leading side surface 18 creates a structure that aggressively attacks a cobble formation, allowing bit 10 to penetrate into gaps between rocks. Further, as best shown in FIG. 5, the upper surface 15 of body 12 is outwardly angled in a radial direction, offsetting front end face 16 of bit 10 from base 14. The combination of the relieved and offset front face with the narrow leading side surface 18 concentrates thrust and rotational forces on corner 20, creating a greater loading on rocks encountered in the formation. Thus, as the bit 10 is rotated and thrust forward, the leading face 16 and leading side surface 18 of bit 10 function in a manner similar to a wedge, penetrating gaps between loose rocks to displace and compact the formation. This in turn, facilitates forcing the rocks to the side as bit 10 forms a bore during drilling operations.

In the illustrated embodiment, leading front face 16 is machined or formed at angle $\alpha$, it will be appreciated that the angled front face could be formed in a number of ways. For example, the angled front face 16 could be constructed with carbide inserts, such as inserts 26, inset along the face from corner, the inserts decreasing in height as the inserts are positioned further away from corner 20. Alternatively, angled front face 16 could be formed by applying hard surfacing material with known welding techniques.

Bit 10 also provides advantages over known bits used in horizontal drilling of cobble formations, and in particular, in steering in a downward direction. Generally, steering a horizontal bit in a loose rock cobble formation can be unpredictable due to the non-uniform nature of typical loose rock cobble formations. Known conventional drill bits utilizing a steering plane tend to rise in loose cobble when drilling straight. The cobble drops by gravity and gets beneath the steering plane, thereby building a ramp of debris that deviates the bit upwardly. A bit according to the invention tends to alleviate this problem through the use of relieved froward end face 16 and narrow leading side surface 18. When steering the bit in a downward direction, a bit 10 according to the invention tends to penetrate under the cobble, lifting the cobble while forcing the bit in a downward direction. Offsetting the front end face 16 further aids in forcing the bit in a downward direction by attacking the formation at a more extreme angle.

Utilizing a steering motion over a limited range of degrees such as described in Runquist U.S. Pat. No. 5,778,991, incorporated by reference herein, with limited movement to the rear allows bit 10 a new 'bite' without letting the cobbles fall to the bottom of the bore. In this method, materials dislodged during the drilling operation serve as a ramp or inclined surface against which the bit is thrust to guide the bit in the desired direction. The use of offset and relieved leading face 16 together with narrow trailing side surface 18, spoon shaped body 12 facilitates steering in this manner. To further aid in steering, bit 10 is also provided with a conical inner surface or face 28 that is offset in that the face widens between leading side surface 18 and trailing side surface 22. As shown, conical inner face 28 is provided with a plurality of carbide stud inserts 26 to protect the bit 10 from abrasion.

A heel 30 centrally located toward the rear of conical face 28 further aids in steering the bit by providing a bearing surface that reacts against material dislodged during boring and formed into a ramp by conical inner face 28. During the boring operation, soil and debris accumulating under conical inner face 28 provides a ramp that aids in steering the bit and also compacts the formation to prevent it from falling back in the bore as the bit is advanced. Conical inner face 28 may also be used to steer bit 10 in soil using the "push to steer" method well known in the art.

Figure 4:
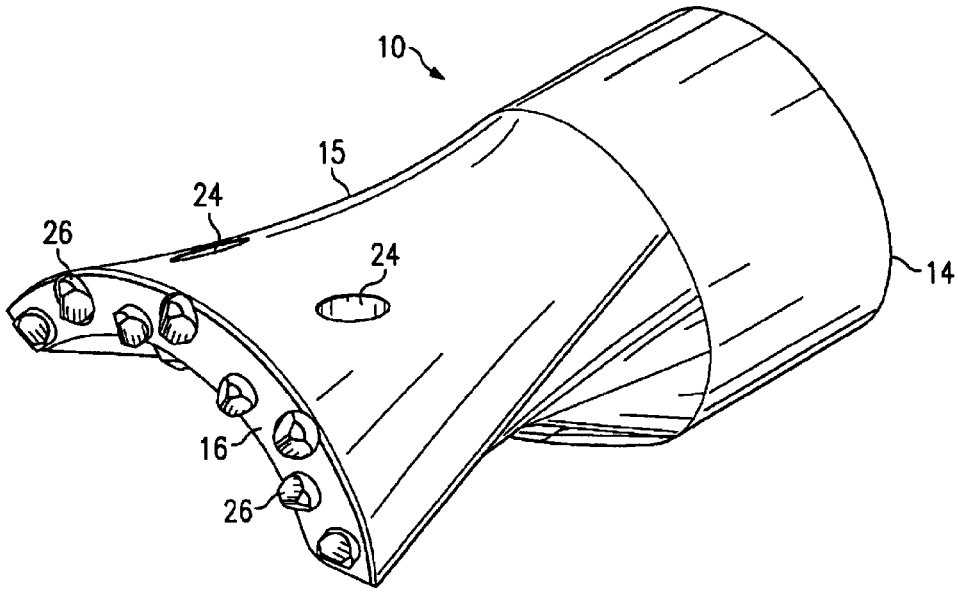
FIG. 4 is a second perspective view of the drill bit of FIG. 1.

As best shown in FIGS. 4 and 5 bit 10 is provided with a plurality of fluid ports or nozzles 24 for the passage of drilling fluid from a drillstring through bit 10 and into the borehole. The drilling fluid serves to clean and lubricate the bit as well as flush away the softer material between the rocks, allowing leading corner 20 of bit 10 to move more easily between the rocks in the formation. As is known in the art, base 14 and body 12 are provided with passages so that drilling fluid pumped through the drill string may flow through bit 10 for ejection directly into the bore hole.

Figure 7:
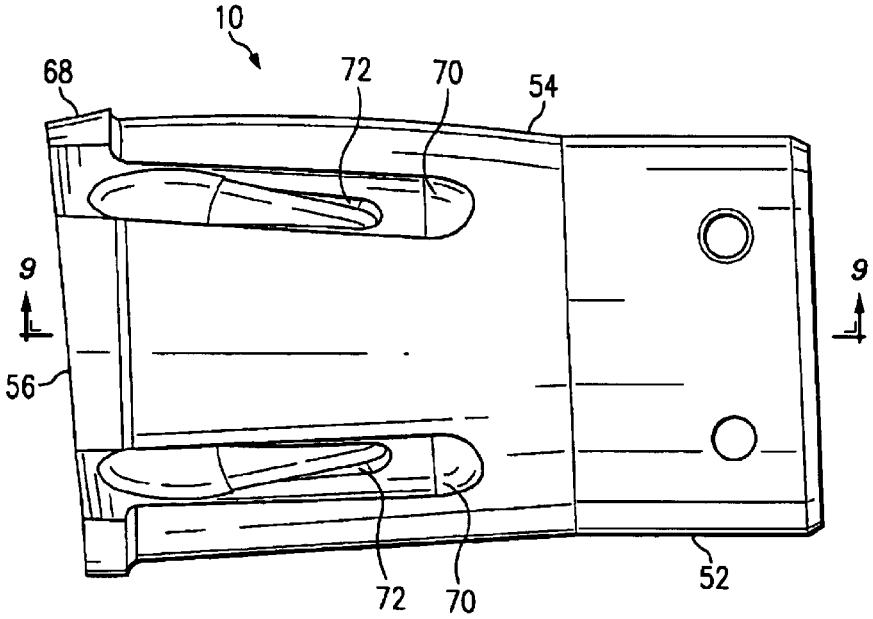
FIG. 7 is a top view of the drill bit of FIG. 6.
Figure 8:
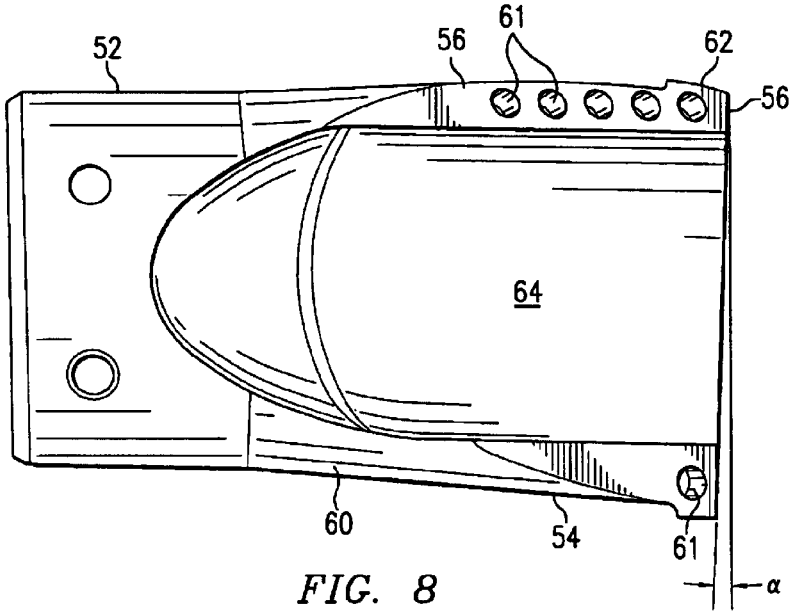
FIG. 8 is a bottom view of the drill bit of FIG. 6.
Figure 9:
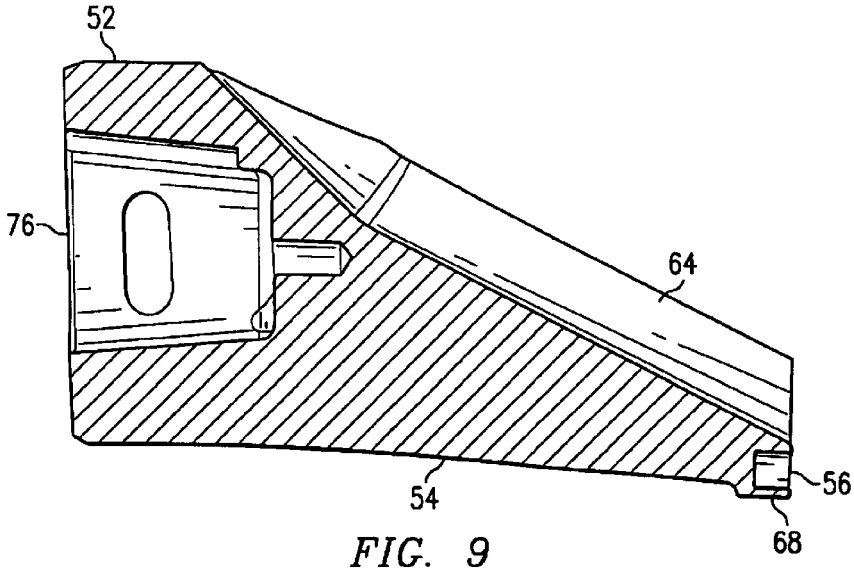
FIG. 9 is a cross sectional view of the drill bit of FIG. 6 taken along line A—A of FIG. 7.
Figure 10:
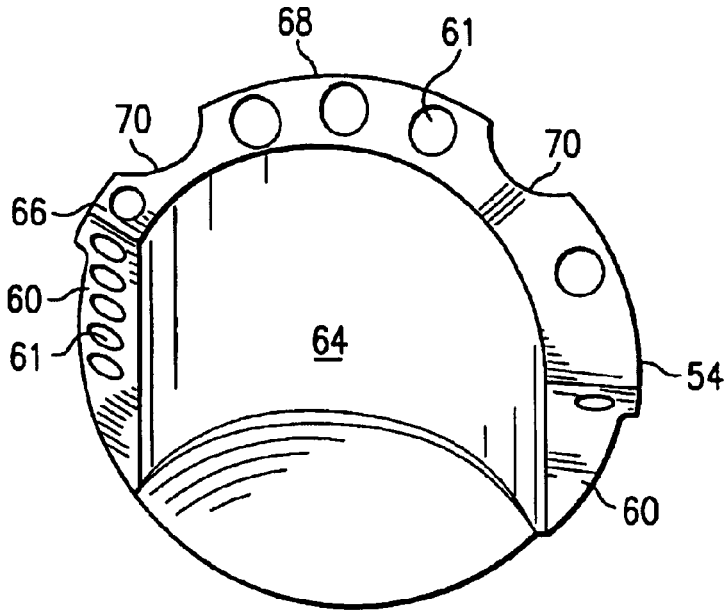
FIGS. 10 and 11 are front and rear views, respectively of the drill bit of FIG. 6.

Turning now to FIGS. 6–10 a second embodiment of a bit 50 in accordance with the invention includes a generally cylindrical base 52 and a spoon-shaped body 54 with a conical inner face 64. As in the case of the embodiment illustrated in FIGS. 1–5 and described above, body 54 includes an angled or relieved front end face 56 and a leading side surface 58 that is narrower than trailing side surface 60. As shown, front end face 56 and leading side surface 58 are provided with a plurality of apertures 61 for receiving carbide studs to protect bit 50 from abrasion during the drilling operation. As best shown in FIGS. 7 and 10 front end face defines a circumferential arc of less than 270 degrees, preferably in the range of 30 to 180 degrees. Front end face 56 is rearwardly inclined from corner 62 at an angle $\alpha$ of up to 30°, preferably from about 5° to about 20°. The combination of angled front end face 56 with narrow leading side surface 58 forms a corner 66 at the intersection of front end face 56 and leading side surface 58 that provides the benefits and advantages of bit 10, described above in connection with FIGS. 1–5.

Body 54 also includes a ridge 68 formed at the forward most end of bit 50, that extends the circumferentially along and terminates in front end face 56 of bit 50. Ridge 68 allows the surface area of front end face 56 to be increased as compared to the embodiment illustrated in FIGS. 1–5, thereby allowing the use of more or larger carbide inserts. As illustrated, top surface 69 of body 54 is angled outward in a radial direction such that front end face is offset as described in connection with the embodiment illustrated in FIGS. 1–5. Body 54 further includes a plurality (2 shown) of grooves 70 that extend longitudinally from front end face 56 rearward over a major portion of the length of body 56.

A fluid port or nozzle 72 positioned in one or more of grooves 70 communicates with one or more fluid passages 74 (FIG. 11) extending through bit 50. Drilling fluid supplied through the drill string (not shown) flows through passages 74 and is ejected through ports 72 into grooves 70. Grooves 70 direct the drilling fluid forward to the front end face 56 to lubricate bit 50 and wash soil and sand from between rocks in the cobble. Washing away the sand and soil between the rocks in the cobble provides openings between the rocks that front end face 56 and corner 66 can bite into as bit 50 is rotated and thrust forward.

Figure 11:
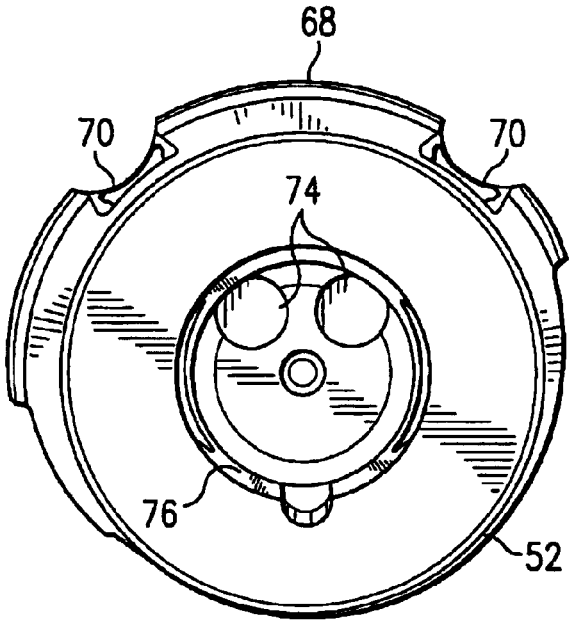

As illustrated in FIGS. 9 and 11 base 52 includes an outwardly opening cavity or socket 76 adapted to receive the male end of a pipe joint similar to the one described in Wentworth et al., U. S. Pat. No. 6,148,935. Alternatively base 52 may be configured and adapted to a variety of known pipe joints. Bits 10 and 50 may be used with known pneumatic impactors to increase the penetration rate through rocky formations, a sonde and sonde housing for locating the bit in the bore and steering and other known tools adapted for horizontal boring.

Although preferred embodiments of the cobble bit of the invention are illustrated in the drawings and described hereinabove, various modifications of the tool may be made within the spirit and scope of the invention. Those skilled in the art will appreciate that although particular embodiments of the invention have been illustrated in the accompanying drawings and described in the foregoing detailed description, it will be understood that the invention is not limited to the embodiments disclosed, but is capable of numerous rearrangements, modifications, and substitutions of parts and elements without departing from the scope of the invention as expressed in the appended claims.

What is claimed is:

1. A drill bit configured for use in horizontal directional boring, the bit comprising: a spoon-shaped body with an arcuate front end face, wherein the front end face widens from a leading edge to a trailing edge in a circumferential direction.

2. The bit of claim 1, further comprising a leading longitudinal face extending rearwardly from one end of the arcuate front end face.

3. The bit of claim 2, further comprising a first row of spaced carbide studs set into the leading longitudinal face, and a second row of spaced carbide studs set into the arcuate front end face.

4. The bit of claim 1, wherein the front face slopes rearwardly from a leading edge to a trailing edge in a circumferential direction.

5. The bit of claim 1 further comprising at least one fluid port for ejecting drilling fluid from the bit into the bore.

6. The drill bit of claim 5 wherein the spoon-shaped body is outwardly offset in a radial direction from the base.

7. The drill bit of claim 5 wherein the arcuate front end face is angled rearwardly at an angle of from about 5° about 20°.

8. The drill bit of claim 7 wherein a row of carbide inserts are positioned in the leading side surface.

9. The drill bit of claim 7 wherein a first wear resistant welded layer of metal is positioned on the leading side surface.

10. The drill bit of claim 7 further comprising a ridge extending arcuately along the front end surface between the leading side surface and the trailing side surface.

11. The drill bit of claim 7 further comprising an offset conical inner surface.

12. The drill bit of claim 5 further comprising a longitudinal groove associated with each port, the port being positioned in the groove so that drilling fluid ejected from the port is directed to the front end face of the bit.

13. The drill bit of claim 5 further comprising a leading side surface and a trailing side surface and wherein the leading side surface is narrower than the trailing side surface.

14. The drill bit of claim 5 further comprising a pair of fluid ports positioned in a pair of longitudinal grooves in the spoon-shaped body, the grooves extending from the fluid ports to the front end face to direct drilling fluid ejected through the ports into the bore adjacent to the front end face.

15. The drill bit of claim 5 further comprising a row of carbide inserts positioned in the front end face.

16. The drill bit of claim 5 wherein the arcuate front end face extends through an arc of from about 30° to 180°.

17. The bit of claim 1 further comprising a longitudinally extending groove, the groove directing the drilling fluid port to the front end face.

18. The drill bit of claim 1 wherein the spoon-shaped body defines a conical, sloped inner bit surface; and a centrally located heel adjacent the rear of the inner bit surface, the heel forming a bearing surface to aid in steering the drill bit.

19. A drill bit configured for use in horizontal directional boring, the bit comprising: a spoon-shaped body having a conical, sloped inner bit surface configured for steering the bit in soil, and having an arcuate front end face, wherein the front face slopes rearwardly from a leading edge to a trailing edge in a circumferential direction.

20. The bit of claim 19, further comprising a leading longitudinal face extending rearwardly from one end of the arcuate front end face.

21. The bit of claim 20, further comprising a first row of spaced carbide studs set into the leading longitudinal face and a second row of spaced carbide studs set into the arcuate front end face.

22. The bit of claim 20 further comprising a first wear resistant welded layer of metal applied to the leading longitudinal face.

23. The bit of claim 20 further comprising a second layer of second wear resistant welded layer of metal applied to the arcuate front end face.

24. The bit of claim 19, wherein the conical, sloped inner surface slopes from rear to front across the width of the spoon-shaped body.

25. The bit of claim 24, further comprising a cylindrical rear end portion rearwardly of the spoon shaped body, the cylindrical rear end portion having means for attachment of the drill bit to a drill string.

26. The drill bit of claim 19 further comprising a centrally located heel adjacent the rear of the conical, sloped inner bit surface, the heel forming a bearing surface to aid in steering the drill bit.

27. A drill bit configured for use in horizontal directional boring, the bit comprising:

a spoon-shaped body and a generally cylindrical base, the base being configured for connection to a drill string;

the spoon shaped body defining a conical inner surface for steering the bit in soil;

an arcuate front end face that slopes rearwardly from a leading edge to a trailing edge in a circumferential direction; and at least one fluid port for ejecting drilling fluid into the bore adjacent to the bit.

28. A drill bit configured for use in horizontal directional boring, the bit comprising:

a base configured for connection to a drill string; and a spoon-shaped body extending from the base, the spoon-shaped body extending outwardly in a radial direction from the base, the spoon shaped body including an arcuate front end face that slopes rearwardly from a leading edge to a trailing edge in a circumferential direction, the spoon-shaped body further having an inner bit surface that slopes from the base to the arcuate front end face across the width of the spoon-shaped body, and leading and trailing side surfaces, the leading side surface being narrower than the trailing side surface.

29. The drill bit of claim 28 wherein the arcuate front end face includes means for reducing wear of the face.

30. The drill bit of claim 28 wherein the leading side surface includes means for reducing wear of the leading side surface.

31. The drill bit of claim 28 wherein the inner bit surface includes means for reducing wear of the surface.

32. The drill bit of claim 28 further comprising a centrally located heel adjacent the rear of the inner bit surface, the heel forming a bearing surface to aid in steering the drill bit.

33. The drill bit of claim 28 further comprising a pair of fluid ports positioned in a pair of longitudinal grooves in the spoon-shaped body, the grooves extending from the fluid ports to the front end face to direct drilling fluid ejected through the ports into the bore adjacent to the front end face.

* * * * *